US005456381A

United States Patent [19]

Fochler

[11] Patent Number: 5,456,381

[45] Date of Patent: Oct. 10, 1995

[54] SUPPLY MAGAZINE FOR A CARTON-ERECTING SYSTEM

[75] Inventor: Fritz Fochler, Senden, Germany

[73] Assignee: Uhlmann PAC-Systeme GmbH & Co. KG, Laupheim, Germany

[21] Appl. No.: 233,233

[22] Filed: Apr. 26, 1994

[30] Foreign Application Priority Data

May 4, 1993 [DE] Germany ..... 43 14 696.1

[51] Int. Cl.[6] ..... B65H 1/00

[52] U.S. Cl. ..... 221/197; 221/268

[58] Field of Search ..... 221/197, 198, 221/232, 210, 220, 268, 272, 274, 282

[56] References Cited

U.S. PATENT DOCUMENTS

| | | | |
|---|---|---|---|
| 3,776,419 | 12/1973 | Zinkgraf | 221/197 |
| 4,854,570 | 8/1989 | Martin et al. | 221/197 |
| 5,265,760 | 11/1993 | Harris et al. | 221/197 |

FOREIGN PATENT DOCUMENTS 2923909 12/1980 Germany .

*Primary Examiner*—Kenneth Noland
*Attorney, Agent, or Firm*—Herbert Dubno; Andrew Wilford

[57] ABSTRACT

The instant invention is used to feed a stack of flattened cartons in which the cartons extend in respective parallel planes and where the stack has an end formed by a frontmost carton. A device for picking the cartons off the stack starting with the frontmost carton includes a grab displaceable along a path passing through a pickup point and operable when at the point to engage and grip the frontmost carton, and a system for displacing the path and thereby moving the location along a generally straight line for setting the picker for cartons of different height. The carton-supply system has a stationary support adjacent the grab path, a supply magazine having a plurality of guide elements extending parallel to a predetermined feed direction and holding the stack of cartons with their planes substantially perpendicular to the feed direction and with the plane of the frontmost carton defining a predetermined acute pickoff angle with the line of the grab, and an adjustment system supporting the magazine guide elements on the support for straight-line movement in an adjustment direction forming with the feed direction an angle equal to generally half of the pickoff angle and for arresting the magazine in any of a multiplicity of positions offset from each other in the adjustment direction.

12 Claims, 7 Drawing Sheets

1
49
50
51
64
II
6
52
51
50
64
12
54
TO 52
CONTROLLER
30
70
48
23
74
8,9
5
TO 75
4
d
II
3
2
2'
73
GRAB DRIVE
75
7

FIG. 6
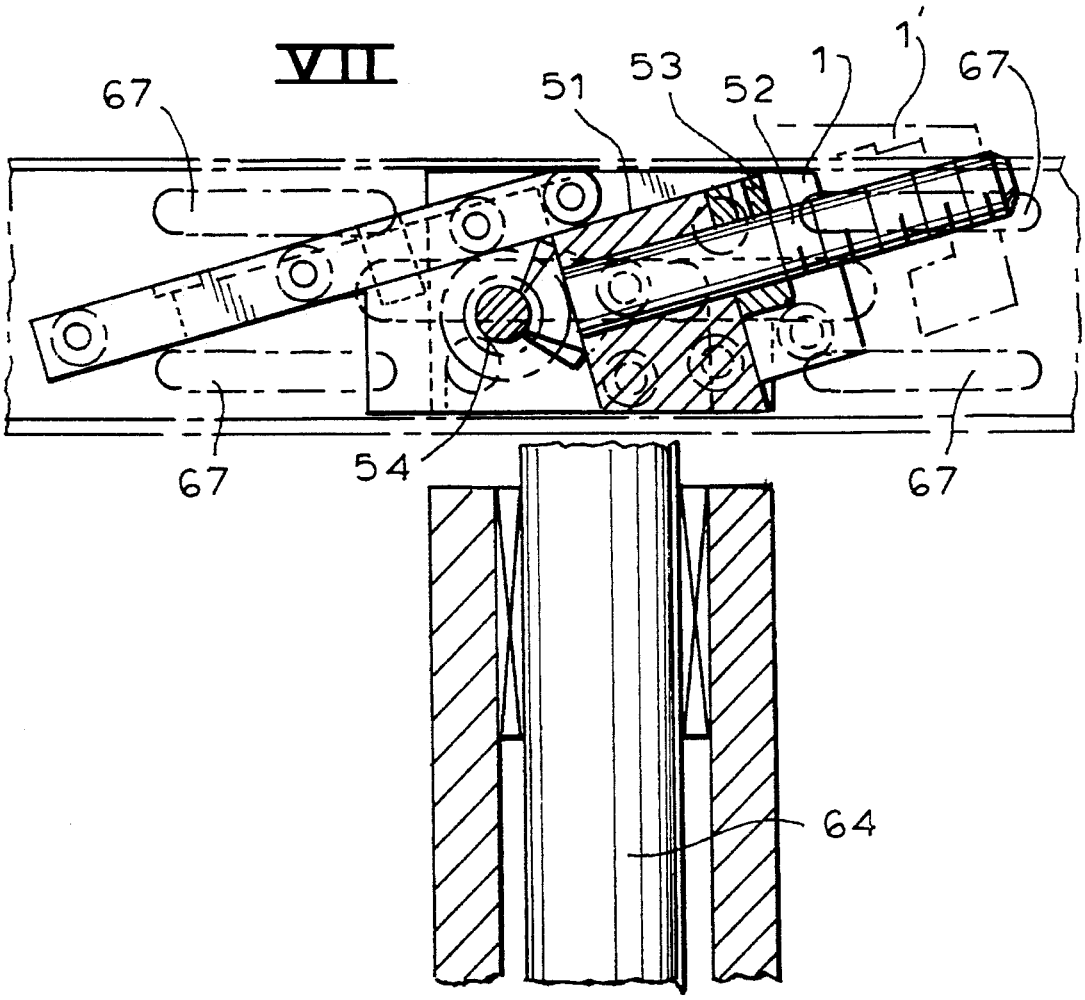
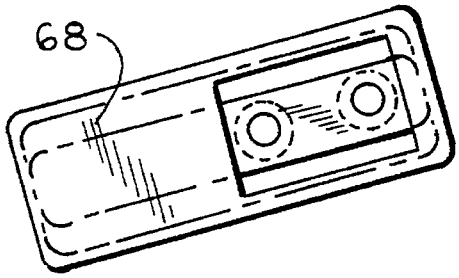
FIG. 7

SUPPLY MAGAZINE FOR A CARTON-ERECTING SYSTEM

FIELD OF THE INVENTION

The present invention relates to a carton-erecting system. More particularly this invention concerns a supply magazine for feeding the flattened cartons to such a system.

BACKGROUND OF THE INVENTION

Cartons or boxes are typically delivered to the user flat and formed with fold lines that permit them easily to be erected into the desired rectangularly parallepipedal shape. In a standard box-erecting apparatus the flat boxes are held in a stack in a magazine from which they are pulled one at a time by a suction grab. An unfolder engages another panel of the box and erects it, and the erected box is deposited in a respective cell of a conveyor that itself comprises a top rail, a bottom rail, and a succession of cell-defining elements that move along between and parallel to the rails. A filling apparatus downstream of the box-erecting system loads the necessary contents into the boxes in the cells, and other devices may be provided to fold in end flaps and seal the boxes.

As described in German patent document 2,923,909 filed Jun. 13, 1979 by Otto Weller and U.S. Pat. No. 5,067,937 of H. Aschaber such an apparatus has a support wheel for the grab and for the unfolder. A parallelogrammatic linkage carries these elements so that even though the wheel moves continuously, the grab's angular movement can be temporarily canceled out for the necessary pickup transfer during which the grab effectively is moved only radially inward on the wheel. Once picked up the box is brought up to the peripheral speed of the wheel as it is erected and is then passed off to the conveyor whose transport speed is equal to the wheel's peripheral speed. Once the erected box is set in its cell in the conveyor, the suction grab releases it and this grab retracts radially back into the wheel, out of the way, while the unfolder is moved back to its starting position.

The supply magazine holds the cartons normally on edge with the frontmost carton, that is the carton on the end of the stack that is picked off by the grab, lying in a plane which forms an angle, herein termed the pickup angle, with the plane in which the grab moves as it contacts and clings to the frontmost carton. The pickup angle is a small acute angle that ensures that the grab engages solidly against the frontmost carton before it pulls it from the stack.

Such a machine is built to work on cartons of different dimensions so that the magazine is adjustable to hold the differently sized flattened cartons. When carton size is changed it is also necessary to adjust the vertical position of the grab relative to the conveyor underneath it. Hence it is also essential to adjust the position of the magazine relative to the grab. To ensure that the grab engages the cartons at the right location the supply magazine is moved vertically to the desired position relative to the grab. Then the magazine must be repositioned horizontally relative to the grab so that the grab will engage the frontmost carton with a force that is sufficient to stick to it but not so large that it displaces the entire stack of cartons or damages the cartons or grab.

This complicated setup whenever carton size is changed is an onerous process.

OBJECTS OF THE INVENTION

It is therefore an object of the present invention to provide an improved carton-supply magazine for a box-erecting system.

Another object is the provision of such an improved carton-supply magazine for a box-erecting system which overcomes the above-given disadvantages, that is which can be adjusted in a simple manner to accommodate cartons of different sizes.

A further object is to provide and improved method of operating and adjusting such a system.

SUMMARY OF THE INVENTION

The instant invention is used to feed a stack of flattened cartons in which the cartons extend in respective parallel planes and where the stack has an end formed by a frontmost carton. A device for picking the cartons off the stack starting with the frontmost carton includes a grab displaceable along a path passing through a pickup point and operable when at the point to engage and grip the frontmost carton, and a system for displacing the path and thereby moving the location along a generally straight line for setting the picker for cartons of different height. The carton-supply system has according to the invention a stationary support adjacent the grab path, a supply magazine having a plurality of guide elements extending parallel to a predetermined feed direction and holding the stack of cartons with their planes substantially perpendicular to the feed direction and with the plane of the frontmost carton defining a predetermined acute pickoff angle with the line of the grab, and an adjustment system supporting the magazine guide elements on the support for straight-line movement in an adjustment direction forming with the feed direction an angle equal to generally half of the pickoff angle and for arresting the magazine in any of a multiplicity of positions offset from each other in the adjustment direction.

Thus with this system, once an initial position for a standard carton is set, when carton size is changed the entire magazine is simply shifted in the angled adjustment direction, automatically making the appropriate vertical and horizontal adjustment for the new box size. By way of example, when carton size is increased the grab and its pickoff point must be raised to allow the larger carton to be set on the underneath conveyor which itself cannot be moved vertically. This raising of the pickoff point therefore positions it back of the outlet end of the magazine so that according to this invention the magazine is moved up and back in the angled adjustment direction. The amount of such displacement according to this invention is determined by the equation:

$$[\sin\alpha/\cos(\alpha/2)]\cdot d=d_1,$$

where $\alpha$=pickoff angle, d=vertical displacement of grab, and $d_1$=angled displacement of magazine.

This movement therefore compensates both for the new position of the pickoff point and the new carton size. Compared to the prior-art system of juggling independent horizontal and vertical displacements in a totally empirical manner, the instant invention allows a controller connected to the grab drive/adjustment system and the magazine-displacement system to automatically reset the magazine whenever the grab height is changed to accommodate a new carton size.

According to the invention the magazine includes a generally horizontal intake portion provided with a conveyor and a downwardly inclined output portion having the guide elements and aligned with the feed direction. The adjustment system includes an actuator braced between the magazine and the stationary support. In addition it has a rotatable threaded spindle anchored on the support and extending parallel to the adjustment direction and a nut threaded on the spindle and anchored on the magazine. To accommodate the difference in position between the magazine and its support, the adjustment system further includes an end shaft journaled in the magazine, an actuating shaft assembly extending transverse to the directions and connected to the end shaft, and a right-angle drive connected between the shaft assembly and the threaded spindle for rotating the threaded spindle by means of the end of the shaft assembly. The shaft assembly itself includes a pair of telescoping shafts connected to the drive and forming the shaft-assembly end, and means rotationally coupling the shafts together. A universal joint is provided between the shaft assembly and the right-angle drive, and another universal joint between the shaft assembly and the end shaft.

The support according to the invention has two spaced parts having surfaces extending parallel to the adjustment direction and the magazine slides in the adjustment direction on the spaced parts. The supply system according to the invention also has means for vertically and horizontally positioning the magazine relative to the grab that is used only for the initial setup; afterward adjustment to accommodate different carton sizes is done wholly in the angled displacement direction.

BRIEF DESCRIPTION OF THE DRAWING

The above and other objects, features, and advantages will become more readily apparent from the following description, reference being made to the accompanying drawing in which:

FIG. 6 is a vertical section according to line VI—VI of FIG. 4 or 5;

FIG. 7 is a top detail view taken in the direction of arrow VII of FIG. 6;

SPECIFIC DESCRIPTION

Figure 1:
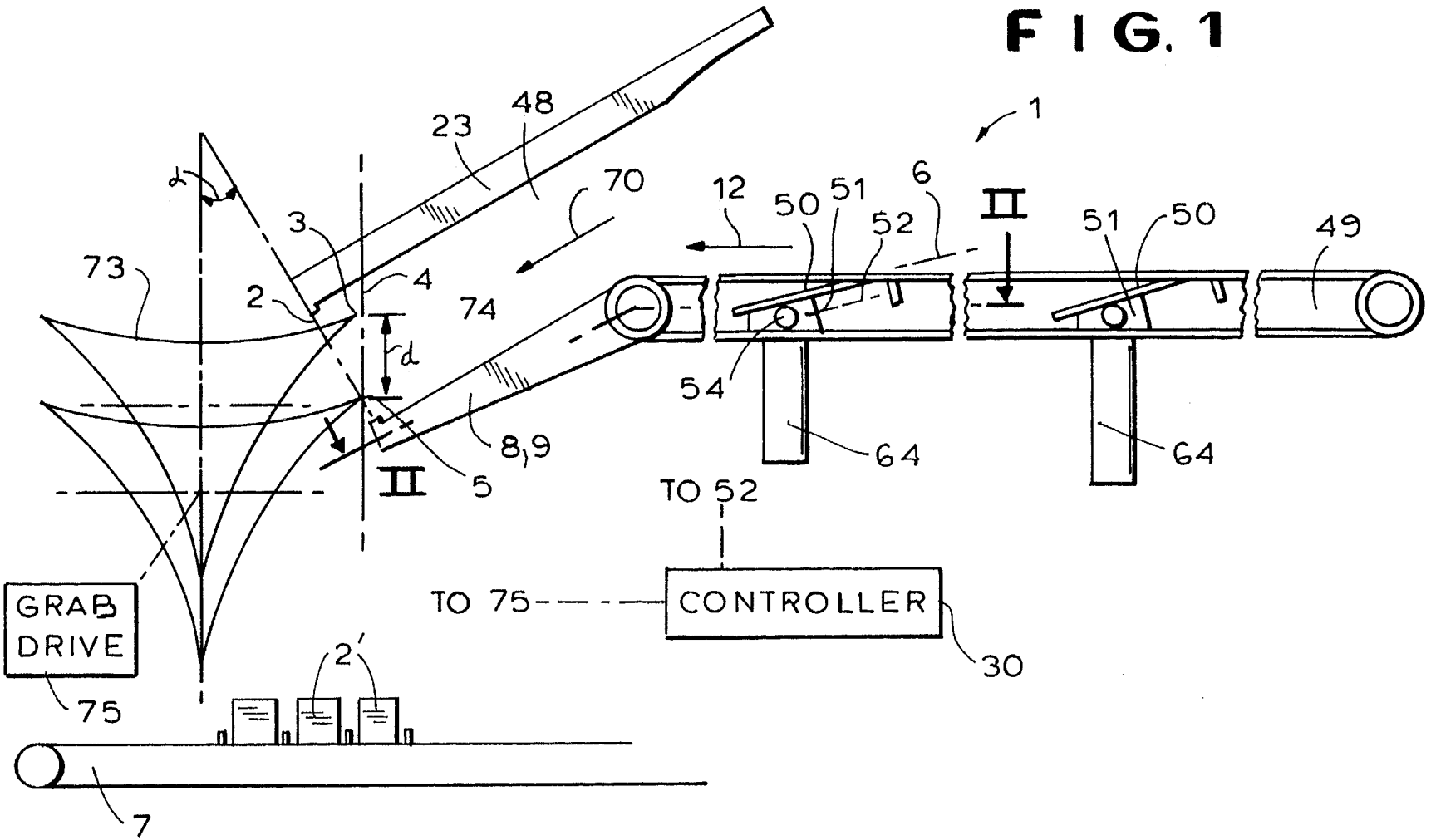
FIG. 1 is a largely schematic and diagrammatic side view illustrating the invention.
Figure 9:
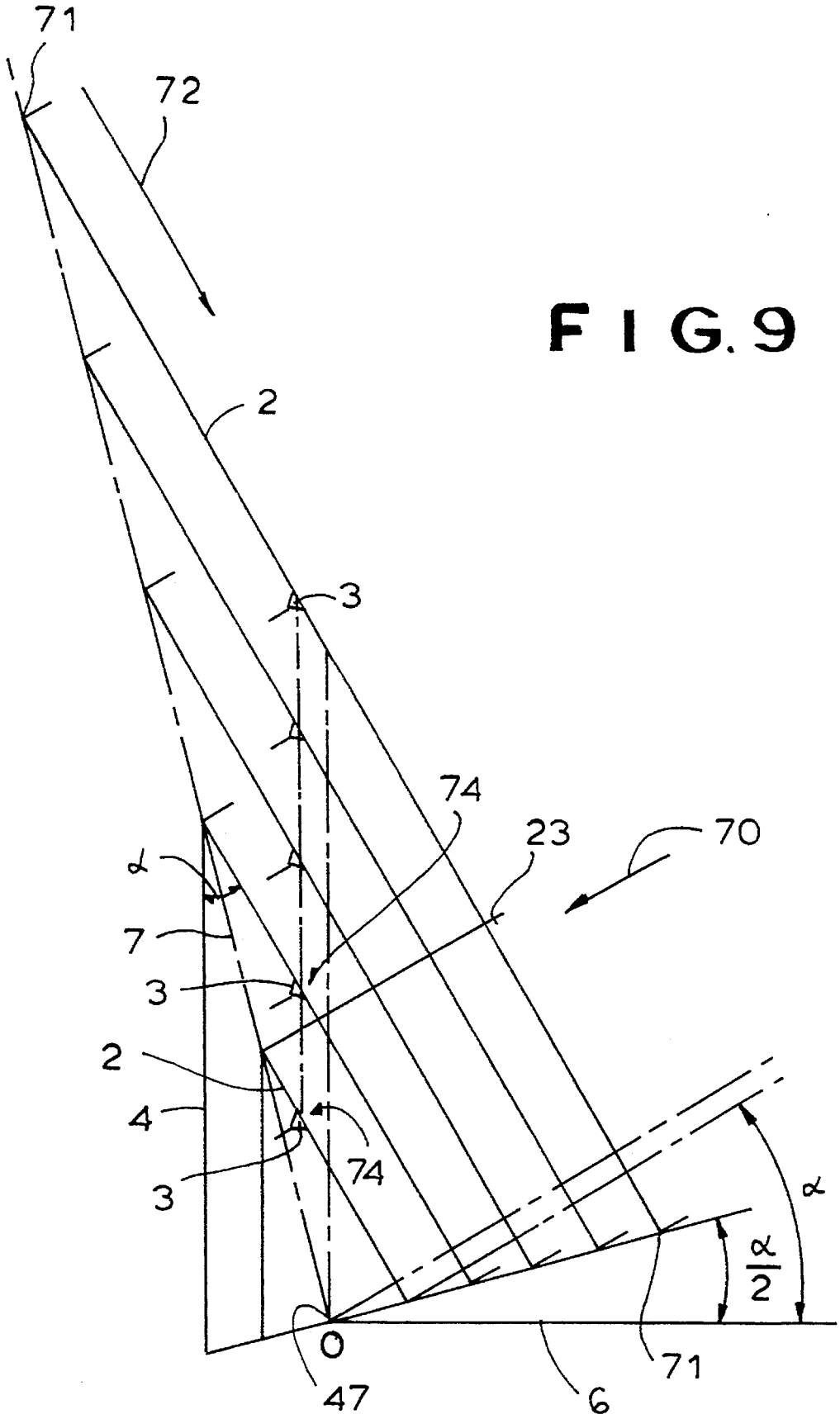
FIG. 9 is a schematic diagram related to FIG. 1 and showing the operation of the system of this invention.

As seen in FIGS. 1 and 9 a supply magazine 1 according to this invention is used in conjunction with a suction grab that is moved by a drive 75 as described in the above-mentioned prior art in a hypocycloidal path 73 along which it passes through a pickup point or location 74. Underneath the grab 3 is a conveyor belt 7 that takes away erected cartons 2'. The magazine 1 has a basically horizontal intake section 49 and a downwardly inclined output section 48. A stack of flattened cartons 2 is displaced in a downwardly inclined direction 70 perpendicular to the planes of the cartons 2 for engagement by the grab 3 at the pickup location 74 so that this grab 3 can pull the frontmost (furthest to the left in FIG. 1) carton 2 out of the magazine 1 past lips 5 defining its downstream end. As is standard, the drive 75 not only moves it along its path 73 but also can displace the center of its path 73 so that the pickup location 74 moves along a straight line 4 which is here vertical. The pickup location 74 must be set so that it engages the flattened carton 2 generally centrally, but not on a fold line such as indicated at 71 in FIG. 9 and the grab 3 must be a certain distance determined by carton size above the belt 7 when it passes the erected box off. Belts 69 displace the cartons 2 horizontally in direction 12 in the intake section 49. The downward inclination of the output section 48 plus the pushing of the upstream cartons ensures feed in this section 48.

The flattened cartons 2 are guided in the feed direction 70 by a pair of lower guide bars or rails 8 and 9 which they sit on, by a pair of side guide bars or rails 10 and 11 (see FIG. 2) that they sit between, and by an upper guide bar or rail 23 that engages downwardly on their upper edges. These guides 8, 9, 10, 11, and 23 ensure that the cartons 2 move perfectly in the direction 70 without shifting relative to each other and while each lying in a plane perpendicular in the section 48 to the direction 70. As described below the guides can be adjusted to accommodate cartons of different sizes.

Figure 4:
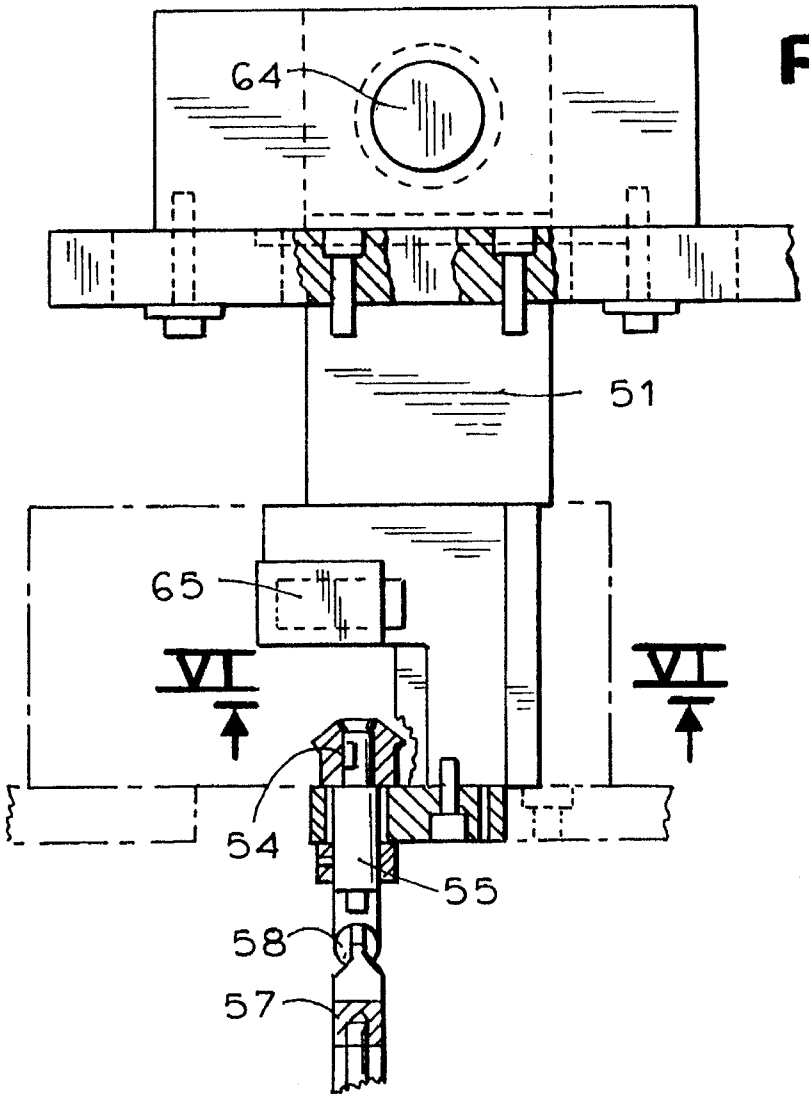
FIG. 4 is a view corresponding to a detail of FIG. 3, but only showing the parts of the machine that do not move for adjustment.
Figure 5:
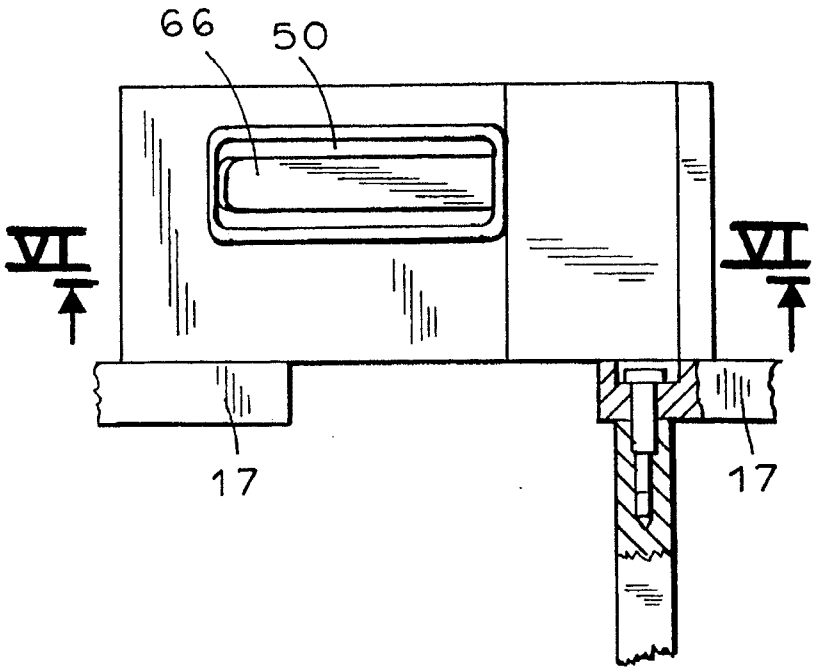
FIG. 5 is a view like FIG. 4 but showing the parts of the machine that do move for adjustment.

The magazine 1 has supports 51 fixed at the upper ends of vertically extensible columns 64 and each formed with a guide block 65 received in a slot 66 (see FIGS. 4 and 5) of a part 50 that can therefore move on the respective fixed support 51 in a direction 6. A cover 68 (FIG. 7) normally prevents dust and the like from getting into the slot 66 and slots 67 are provided for horizontal adjustment of the magazine 1. According to the invention this direction 6 is not parallel to the feed direction 70 (which itself is parallel to the guides 8, 9,10, 11, and 23) and is not perpendicular to the adjustment direction 4 of the grab 3. More specifically as seen in FIGS. 1 and 9 the magazine 1 is oriented so that the planes of the cartons form an angle $\alpha$, here 30°, with the grab-adjustment direction 4. The magazine-adjustment direction 6, however, forms an angle $\alpha/2$ (here 15°) with the feed direction 70 which is perpendicular to the planes of the cartons 2 so that it forms an angle of $(90+[\alpha/2])°$ or 105° with the direction 4. This ensures as will be described below that the pickoff point 74 will always be properly oriented on the carton 2 being picked when the machine is adjusted for cartons of different sizes.

Figure 2:
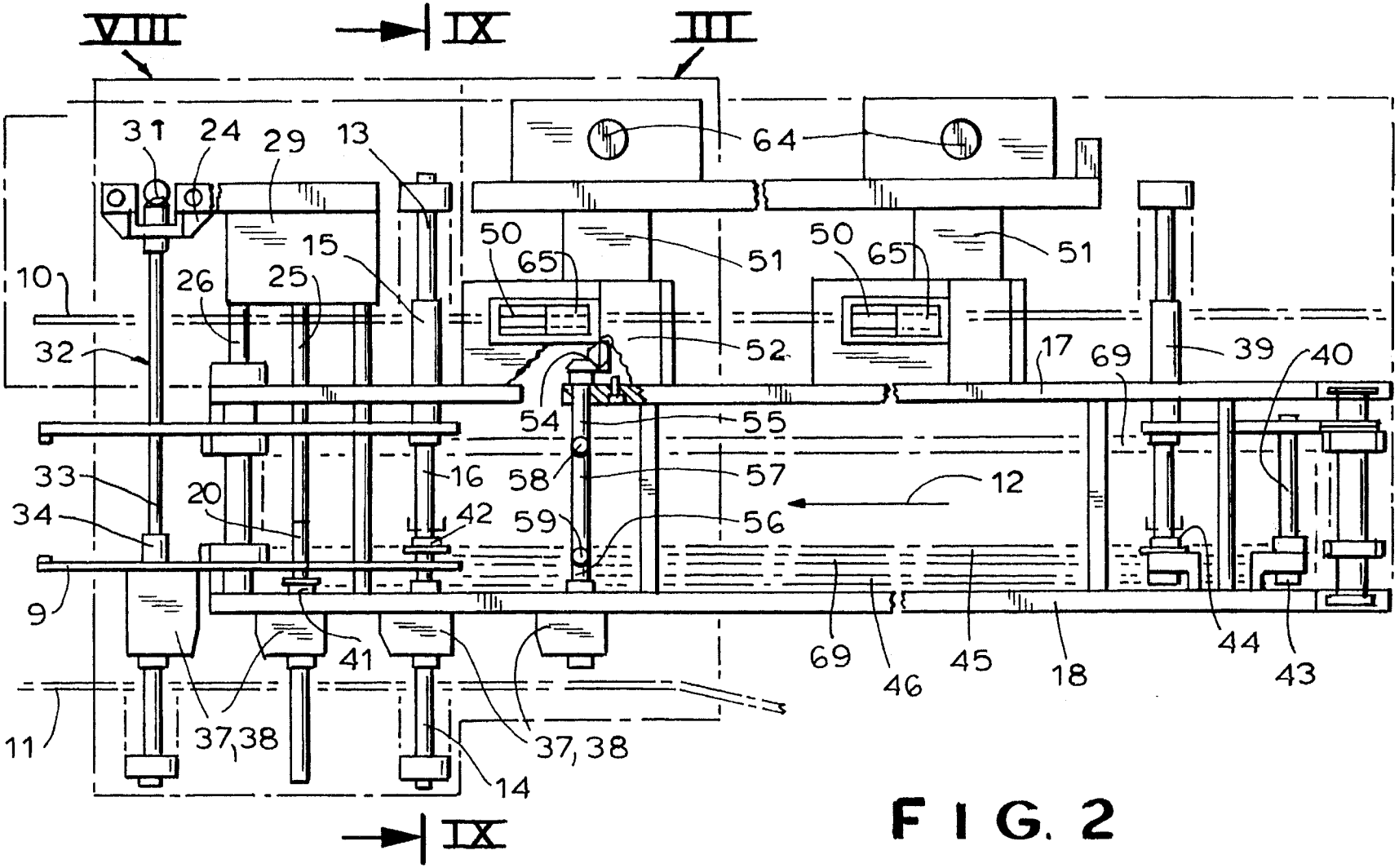
FIG. 2 is a mainly horizontal and partly diagrammatic section taken along line II—II of FIG. 1.
Figure 3:
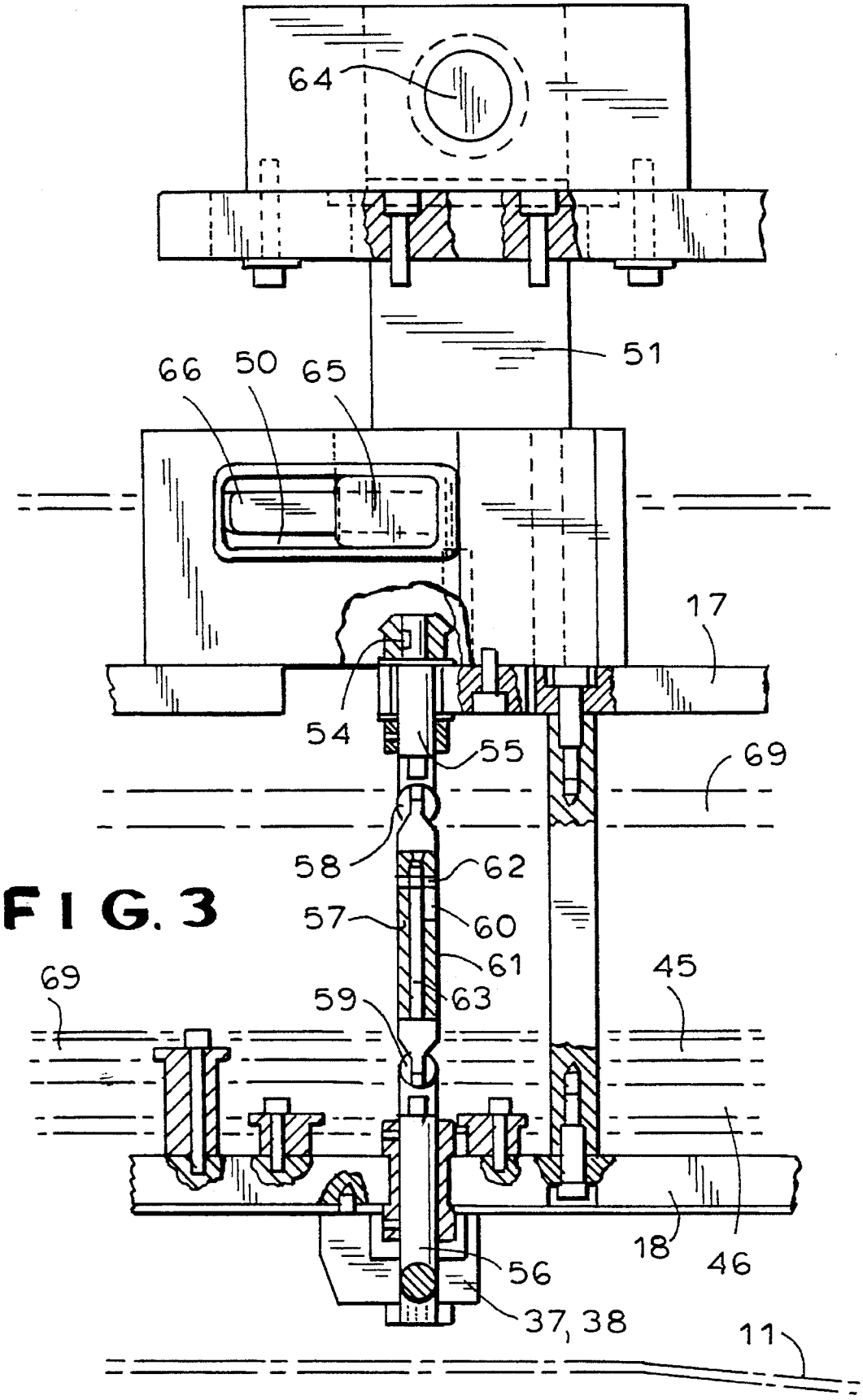
FIG. 3 is a large-scale view of the detail of FIG. 2 indicated at III.

As seen best in FIG. 2 according to the invention the front support parts 50 can move on the parts 51 in the direction 6. A threaded spindle 52 extending parallel to the direction 6 has one end fixed in the stationary part 51 and another end threaded in a nut 53 fixed on the respective movable part 50. The front end of the shaft 52 is connected via bevel gears 54 to a shaft 55 journaled in a frame member 17 fixed to the movable parts 50 and extending horizontally perpendicular to a plane defined by the directions 70 and 6. The shaft 55 is coupled via a shaft assembly 57 to another shaft 56 journaled in a frame member 18 fixed relative to the member 17 and carrying position-sensor/display units 37 and 38. The shaft assembly 57 comprises a tube shaft 61 formed with a slot 60 and telescoping with a core shaft 63 having a radially projecting pin 62 engaging in the slot 60 and rotationally coupling the two shafts 61 and 63, with universal joints 58 and 59 connecting the ends of the shaft assembly 57 to the respective shafts 55 and 56. Thus this shaft assembly 57 allows the shaft 55 on the fixed part 51 to move relative to the shaft 56 which is fixed relative to the movable part 50.

Figure 8:
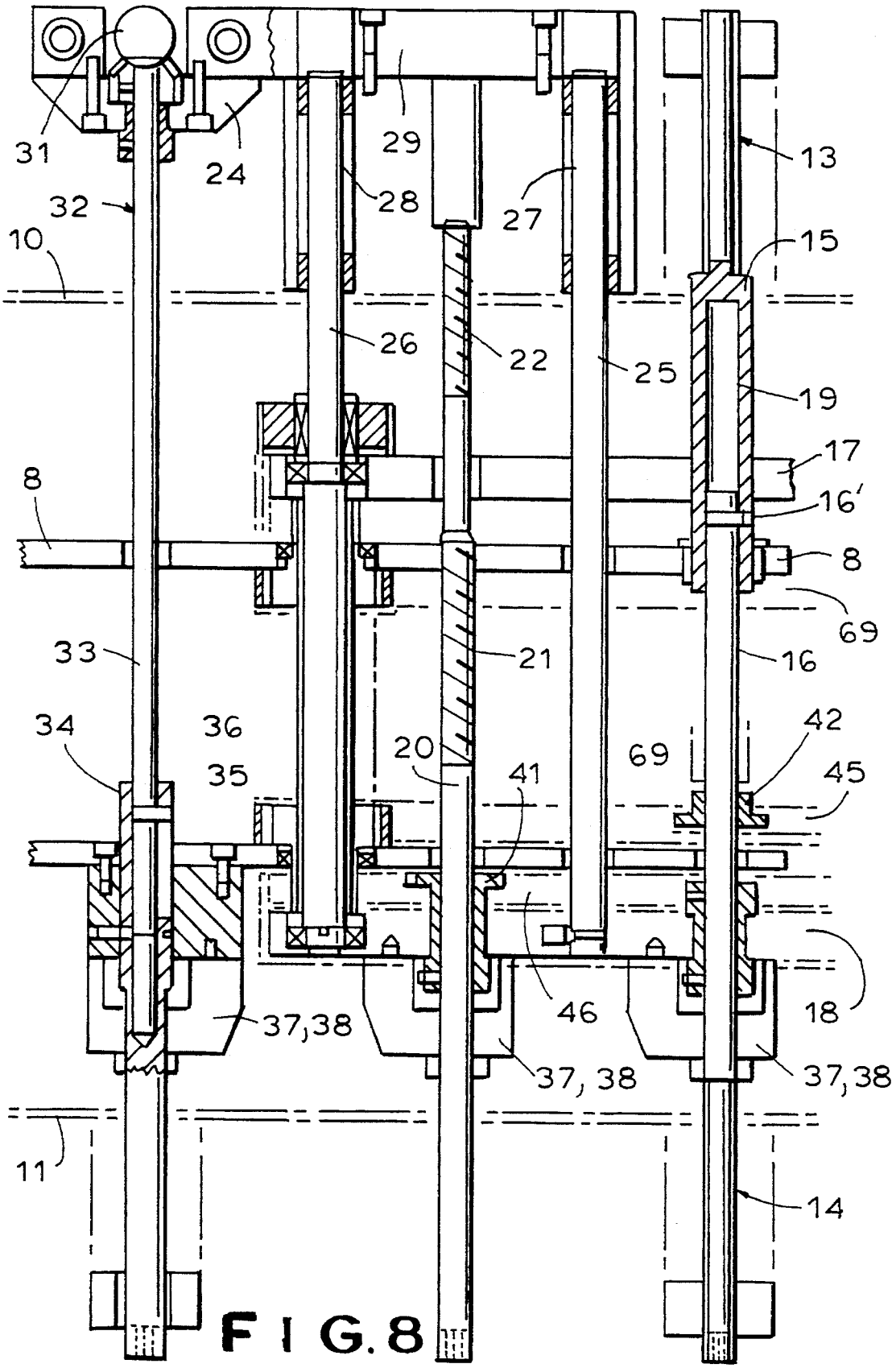
FIG. 8 is a large-scale view of the detail of FIG. 2 indicated at VIII.

A spindle 20 best seen in FIG. 8 fixed axially in the frame member 18 and coupled to another sensor/display unit 37, 38 has an inner screwthread 21 engaged in the movable bottom rail 8 and an outer screwthread 22 threaded into an extension 29 of a bracket 24 on which the upper guide rail 23 is carried. Transverse rods 25 and 26 pass through in the rail 8 and fit in holes 27 and 28 in the extension 29 to support the bracket 24 and allow it to move smoothly transversely. The pitch of the screwthread 21 is half that of the screwthread 22 so that when the shaft 20 is rotated in one direction the guide rail 8 will be moved transversely through a distance that is half that through which the bracket 24 carrying the upper rail 23 will move.

The vertical position of the upper rail 23 is set by a shaft assembly including a tube shaft 34 axially fixed and journaled in the rail 9, which is fixed to the frame member 18 and a core shaft 33 telescoping in the shaft 34 and having a pin 36 fitting in an axial slot 35 thereof. The outer end of the core shaft 33 is fixed in the bracket 24 and connected via bevel gearing 31 to an unillustrated vertical threaded spindle which raises and lowers, depending on rotation direction of the shaft assembly 32, the upper guide rail 23.

FIG. 8 also shows how coaxial adjustment spindles 13 and 14 respectively threaded into elements carrying the side guide bars 10 and 11 are journaled in the frame members 17 and 18 and respectively extended as a tube shaft 15 and a core shaft 16 respectively axially fixed in the adjustable bottom rail 8 and the frame member 18. The core shaft 16 telescopes in the tube shaft 15 and carries a radially projecting pin 16' engaged in an axially extending slot 19 of the shaft 15 to rotationally couple the spindles 13 and 14 while permitting them to move axially relative to each other, while at the same time maintaining the movable bottom guide rail 8 roughly midway between the side rail 10 and bottom rail 9. Thus rotation in one direction of the adjusters 13 will spread the side guide rails 10 and 11 and opposite rotation will bring them together.

At the upstream end of the magazine as seen in FIG. 2 is a shaft/adjuster unit 40 that is similar to the shaft 20 and screwthread 21 for laterally displacing the upstream end of the movable bottom guide 8 synchronously with its downstream end. Sprockets 43 and 41 on the shafts 20 and 40 are interconnected by a toothed belt or chain 46 so that they rotate synchronously.

Similarly a shaft assembly 39 substantially identical to the assembly 13, 14 is provided at the upstream end of the magazine for adjusting the lateral position the side guide 10. Sprockets 42 and 44 on the shafts 16 and 39 are interconnected by a toothed belt or chain 45 to ensure synchronous rotation and synchronous lateral displacement of the upstream and downstream ends of the guide 10.

Thus when the box size changes, for instance by a dimension d in the direction of arrow 72 of FIG. 9, the shaft assembly 32 is operated by an automatic controller 30 connected to the spindles 52 and to the grab drive/adjuster 75 to make the necessary movement of the upper rail 23. In addition the entire magazine 1 is moved back (to the right in FIG. 1) in the direction 6 through a distance $d_1$ equal to $$[\sin\alpha/\cos(\alpha/2)]\cdot d.$$

This adjustment will automatically set the frontmost carton relative to the pickoff point 74 such that transfer to the grab 3 will be perfect. The machine operator need not make two related adjustments in the horizontal and vertical direction; instead the adjustment in direction 6 will automatically put the magazine 1 in the right position for the carton size.

I claim:

1. In combination with:

a stack of flattened cartons with the cartons extending in respective parallel planes and the stack having an end formed by a frontmost carton; and means for picking the cartons off the stack starting with the frontmost carton and including a grab displaceable along a path passing through a pickup point and operable when at the point to engage and grip the frontmost carton, and means for displacing the path and thereby moving the location along a generally straight line for setting the picking means for cartons of different height;

a carton-supply system comprising:

a stationary support adjacent the grab path;

a supply magazine having a plurality of guide elements extending parallel to a predetermined feed direction and holding the stack of cartons with their planes substantially perpendicular to the feed direction and with the plane of the frontmost carton defining a predetermined acute pickoff angle with the line of the grab; and adjustment means supporting the magazine guide elements on the support for straight-line movement in an adjustment direction forming with the feed direction an angle equal to generally half of the pickoff angle and for arresting the magazine in any of a multiplicity of positions offset from each other in the adjustment direction.

2. The carton-supply system defined in claim 1 wherein the magazine includes a generally horizontal intake portion provided with a conveyor and a downwardly inclined output portion having the guide elements and aligned with the feed direction, the adjustment means including an actuator braced between the magazine and the stationary support.

3. The carton-supply system defined in claim 2 wherein the adjustment means includes:

a rotatable threaded spindle anchored on the support and extending parallel to the adjustment direction, and a nut threaded on the spindle and anchored on the magazine.

4. The carton-supply system defined in claim 3, wherein the adjustment means further includes:

an end shaft journaled in the magazine, an actuating shaft assembly extending transverse to the directions and connected to the end shaft, and a right-angle drive connected between the shaft assembly and the threaded spindle for rotating the threaded spindle by means of the end of the shaft assembly.

5. The carton-supply system defined in claim 4 wherein the shaft assembly comprises:

a pair of telescoping shafts connected to the drive and forming the shaft-assembly end, and means rotationally coupling the shafts together.

6. The carton-supply system defined in claim 5, further comprising a universal joint between the shaft assembly and the right-angle drive, and another universal joint between the shaft assembly and the end shaft.

7. The carton-supply system defined in claim 5, further comprising means for monitoring the rotation of the shaft assembly.

8. The carton-supply system defined in claim 1 wherein the support has two spaced parts having surfaces extending parallel to the adjustment direction and the magazine slides in the adjustment direction on the spaced parts.

9. The carton-supply system defined in claim 1, further comprising means for vertically and horizontally positioning the magazine relative to the grab.

10. A method of operating a carton-supply system used in combination with:

a stack of flattened cartons with the cartons extending in respective parallel planes and the stack having an end formed by a frontmost carton; and means for picking the cartons off the stack starting with the frontmost carton and including a grab displaceable along a path passing through a pickup point and operable when at the point to engage and grip the frontmost carton;

the carton-supply system comprising:

a stationary support adjacent the grab path; and a supply magazine having a plurality of guide elements extending parallel to a predetermined feed direction and holding the stack of cartons with their planes substantially perpendicular to the feed direction and with the plane of the frontmost carton defining a predetermined acute pickoff angle with the line of the grab, the method comprising the step when carton size changes of displacing the path and thereby moving the location along a generally straight line for setting the picking means for cartons of different height, and displacing the magazine in a straight line in an adjustment direction forming with the feed direction an angle equal to generally half of the pickoff angle and arresting the magazine in one of a multiplicity of positions offset from each other in the adjustment direction.

11. The operating method defined in claim 10 wherein when the path is displaced through a distance d the magazine is displaced in the adjustment direction through a distance equal to ·d, where $\alpha$ is the pickoff angle.

12. The operating method defined in claim 11 wherein as carton height increases the magazine is moved away from the path and vice versa.

* * * * *